United States Patent [19]

Brule et al.

[11] Patent Number: 5,070,657

[45] Date of Patent: Dec. 10, 1991

[54] DEVICE FOR FASTENING A HOLDING PART ON AN EYEGLASS LENS

[75] Inventors: Francois Brule, Champigny; Jean-Louis Carriou, Roissy en Brie; Christian Joncour, Saint Maurice, all of France

[73] Assignee: Essilor International Cie Generale d'Optique, Creteil Cedex, France

[21] Appl. No.: 588,355

[22] Filed: Sep. 26, 1990

[30] Foreign Application Priority Data

Sep. 29, 1989 [FR] France ..... 89 12735

[51] Int. Cl.[5] ..... B24B 13/005

[52] U.S. Cl. ..... 51/277; 51/216 LP

[58] Field of Search ..... 51/277, 216 LP, 217 L

[56] References Cited

U.S. PATENT DOCUMENTS 4,543,752 10/1985 Kötting ..... 51/277

FOREIGN PATENT DOCUMENTS 2608492 6/1988 France .

1126599 9/1968 United Kingdom .

*Primary Examiner*—Roscoe V. Parker

*Attorney, Agent, or Firm*—Charles A. Brown

[57] ABSTRACT

A device for fastening a holding part on an eyeglass lens placed on a plate comprises an arm adapted to receive removably the holding part and a carriage on which the arm is able to pivot between a loading and offloading position and a fitting position. The carriage is mobile on a frame between a rest position and an end of travel position over a path on which the arm is brought into alignment in the fitting position with the plate. The carriage is at least in part adapted to move in a straight line in a first direction controlled by a guide fastened to the frame and the pivot axis of the arm is in a second direction orthogonal to the first direction. A belt and gear transmission is operative between the carriage and the arm to move the arm from one end position to the other.

20 Claims, 4 Drawing Sheets

DEVICE FOR FASTENING A HOLDING PART ON AN EYEGLASS LENS

BACKGROUND OF THE INVENTION

1. Field of the invention

The present invention is generally concerned with fitting a holding part onto an eyeglass lens to be worked on, for example trimmed, the holding part being adapted to adhere to the lens temporarily, by means of a sucker, for example, to enable the lens to be fitted to and locked in position on a machine for carrying out the work.

2. Description of the prior art

Devices for fastening a holding part on an eyeglass lens form part of centering devices, for example, used before the work is carried out to define either the geometrical center of the eyeglass lens to be worked on or its optical center, the holding part having then to be fitted at a specific location relative to one or the other of these centers.

In practise they comprise an arm which is adapted to receive removably the holding part to be fitted to the eyeglass lens and a carriage on which the arm pivots between two end positions, namely a loading and offloading position and a fitting position. Carried by a frame, the carriage is mobile between two end positions on the frame, namely a rest position and an end of travel position, during which movement the arm is moved into alignment in the fitting position with a plate on which the eyeglass lens is placed beforehand.

This is the case, for example, in American Pat. No 4,543,752.

According to this American patent the carriage carrying the arm can be moved manually or by a motor.

In either case the arm pivots in the same direction as the carriage moves, with a screw-and-nut type coupling between it and the carriage.

This type of coupling inevitably produces significant friction, compromising efficiency.

A general object of the present invention is an arrangement which is advantageously free of this disadvantage and is also suitable for manual or motorized operation.

SUMMARY OF THE INVENTION

The present invention consists in a device for fastening a holding part on an eyeglass lens placed on a plate, comprising an arm adapted to receive removably said holding part, a carriage on which said arm is able to pivot between a loading and offloading end position and a fitting end position and a frame on which said carriage is mobile between a rest end position and an end of travel end position over a path on which said arm that it carries is brought into alignment in said fitting end position with said plate, in which device said carriage is at least in part adapted to move in a straight line in a first direction controlled by a guide fastened to said frame and the pivot axis of said arm is in a second direction orthogonal to said first direction, and a belt and gear transmission is operative between said carriage and said arm to move said arm from one end position to the other.

The transmission comprises, for example, constrained to rotate together by at least one belt, a rotary gear with which the arm pivot axis rotates, at least one rotary gear carried by the carriage and at least one rotary gear that is fixed in position relative to the frame.

This transmission moves the carriage from one of its end positions to the other and the arm from one of its end positions to the other, and these movements are advantageously performed highly efficiently.

The document FR-A-2.608.492 discloses a device for fastening a holding part on an eyeglass lens in which the arm is pivoted on a block which moves in a straight line like a carriage.

However, this document does not disclose any transmission, in the sense of the present invention, between the arm and the carriage and necessarily therefore discloses no belt and gear transmission, the arm being moved from one position to the other, as is the block which it carries, by cam means carried by another block movable in synchronism with the first but in the opposite direction.

In both cases the devices for fastening a holding part to an eyeglass lens are therefore very different in configuration.

The characteristics and advantages of the invention will emerge from the following description given by way of example only with reference to the appended diagrammatic drawings.

DETAILED DESCRIPTION OF THE PREFERRED EMBODIMENTS

As shown in the figures, the overall objective is to fasten onto an eyeglass lens 10 placed on a plate 11 a holding part 12 including for this purpose a sucker 13, for example.

Figure 1:
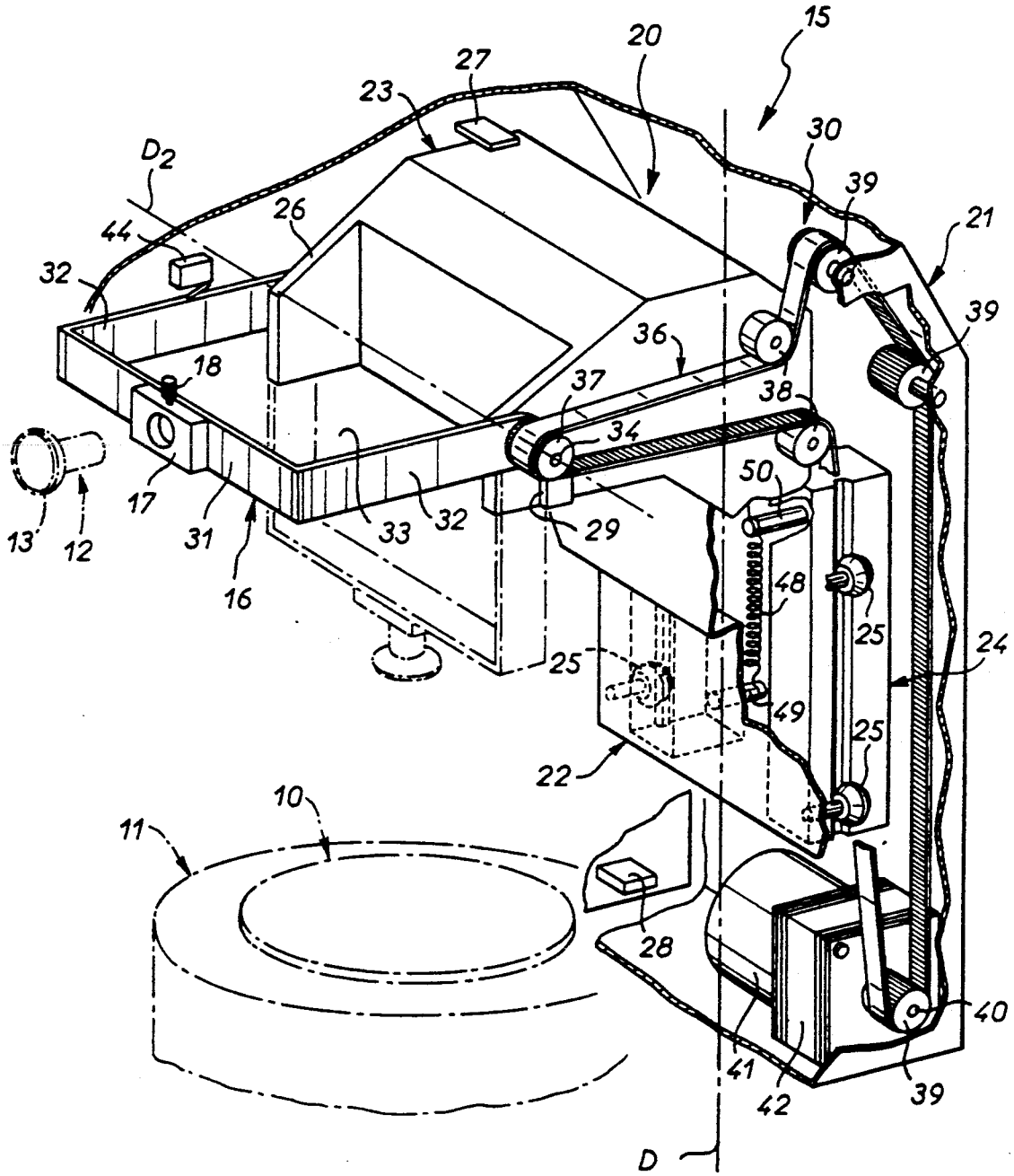
FIG. 1 is a locally cut away perspective view of a device in accordance with the invention for fastening a holding part on an eyeglass lens.

In the embodiment shown in FIGS. 1 through 4 the device 15 employed to this end comprises an arm 16 with a receptacle 17 at the front adapted to receive removably, by tightening a screw 18, the holding part 12 to be fastened to the lens and a carriage 20 on which the arm 16 pivots between two end positions, namely a loading and offloading position shown in full line in FIG. 1 and a fitting position shown in chain-dotted line in FIG. 1. Carried by a frame 21, of which only various parts are shown in FIG. 1, the carriage 20 is itself mobile between two end positions, namely a rest position shown in FIG. 1 and an end of travel position on the frame 21. As will be explained in more detail later, as the carriage moves along this path the arm 16 that it carries is aligned in the fitting position with the plate 11.

The plate 11 may be part of the device 15.

It may instead be part of the equipment (centering or other equipment) to which the device 15 is adapted to be fitted.

For this reason it, the eyeglass lens 10 and the holding part 12 are shown in chain-dotted outline in FIG. 1.

The position of the plate 11 is fixed relative to the frame 21.

In the embodiments shown in FIGS. 1 through 4 the carriage 20 is in one piece and generally inverted L-shape with a vertical portion 22 and a horizontal portion 23 cantilevered out from the latter.

As the carriage 20 does not of itself form any part of the present invention it will not be described in more detail here.

Suffice to say that by virtue of a guide 24 fastened to the frame 21 with which it is engaged through rollers 25 it moves in a straight line in a first direction D1, in practise vertically, perpendicularly to the plate 11, it has an abutment 29 against which the arm 16 bears when in the fitting position, and, for reasons that will emerge later, the end 26 of its horizontal portion 23 is preferably in the form of a yoke, as shown here.

As the frame 21 does not of itself form any part of the present invention it will not be described in more detail here, either.

Suffice to say that, to delimit the maximum travel of the carriage 20, it carries projecting top and bottom abutments 27 and 28, respectively.

According to the invention, the pivot axis of the arm 16 extends in a second direction D2 orthogonal to the first direction D1 and there is operative between the carriage 20 and the arm 16 a belt and gear transmission 30 adapted to move the arm 16 from one of its end positions to the other.

In this embodiment the arm 16 is stirrup-shape with a central part 31 carrying the receptacle 17 and two side arms 32 by means of which it is articulated to the front part 26 of the carriage 20.

In the loading and offloading position (FIGS. 1, 2 and 3A) arm 16 delimits with the yoke configuration of the front part 26 of the carriage 20 an aperture 33 through which the plate 11 can be illuminated if required.

Its pivot axis is formed by two journals 34 fastened to its respective arms 32, only one of which is visible in FIG. 1.

Hereinafter the pivot axis of the arm 16 will also be denoted by the reference number 34.

As shown here by way of example, the transmission 30 comprises, constrained to rotate together by at least one belt 36, a gear 37 which rotates with the pivot axis 34 of the arm 16, at least one gear 38 carried by the carriage 20, and at least one gear 39 fixed in position relative to the frame 21.

Figure 2:
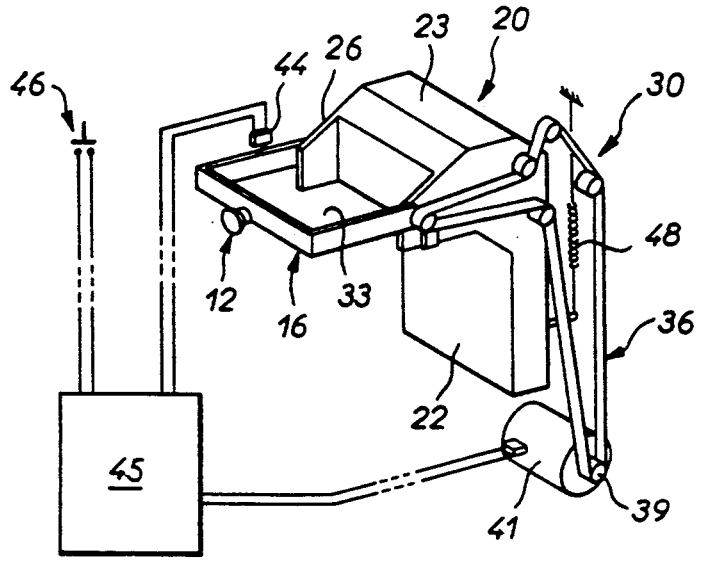
FIG. 2 is a schematic showing the device in perspective with its control system.

In the embodiment specifically shown in FIGS. 1 through 3 there is a single belt 36 to one side of the carriage 20 running in an endless loop around the rotating gear 37, two rotating gears 38 carried by the carriage 20 and on respective sides of the rotating gear 37, and two rotating gears 39 fixed in position relative to the frame 21 and disposed at respective sides of the carriage 20, one towards the top abutment 27 defining one of its end positions and the other towards the bottom abutment 28 defining the other.

In this embodiment there is an additional rotating gear 39 on the frame 21.

The inside of the belt 36 contacts the gear 37 and the gears 39. Its outside contacts the gears 38. It is preferably a notched belt.

The two gears 38 carried by the carriage 20 are substantially in alignment and spaced from the gear 37 with which the pivot axis 34 of the arm 16 rotates.

Ignoring a slight offset which is compensated by the additional gear 39, which is substantially vertically aligned with the gear 39 towards the bottom abutment 28, the gears 39 carried by the frame 21 towards the top abutment 27 and the bottom abutment 28 are substantially in alignment to the rear of the gears 38.

The belt 38 therefore forms two loops overall, one substantially vertical and the other substantially horizontal and intermediate the ends of the former.

In this embodiment at least one of the gears 37, 38, 39 rotates with the output shaft 40 of a motor 41, optionally through a speed reducer 42 as shown here.

In practice this is one of the gears 39 fixed in position relative to the frame 21, in this specific embodiment that towards the bottom abutment 28.

The motor 41 is carried by the frame 21 and is in practise an electric motor. In the loading and offloading position one arm 32 of the arm 16 operates a microswitch type, for example, end of travel sensor 44 carried by the frame 21 and controlling the supply of electrical power to the electric motor 41.

As schematically shown in FIG. 2 the supply of electrical power to the electric motor 41 is governed by a control unit 45 controlled by the end of travel sensor 44 and a pushbutton 46 accessible to the operator.

As the control unit 45 does not of itself form any part of the present invention it will not be described here.

In addition to the drive means comprising the electric motor 41 and the transmission 30, the carriage 20 is acted on by return spring means 48 which urge it at all times towards its rest position, in other words towards the top abutment 27.

In this embodiment the return spring means 48 comprise a tension spring attached by a pin 49 to the carriage 20 and by a pin 50 to the frame 21.

These return spring means 48 are preferably designed so that the force they apply to the carriage 20 as it moves towards its rest position is sufficient to hold the arm 16 against the abutment 29 provided for it on the carriage 20 and thus to hold the arm 16 in its fitting position.

At the start of a working cycle the carriage 20 is at its top or rest position, held against the top abutment 27 by the return spring means 48. At this time the arm 16 is in the deployed or loading and offloading position in which it operates the end of travel sensor 44 (see FIGS. 1, 2 and 3A).

In this deployed loading and offloading position, which is horizontal, the arm 16 advantageously presents the receptacle 17 to the front, which facilitates fitting the holding part 12 into it.

Figures 3A, 3B, 3C, 3D:
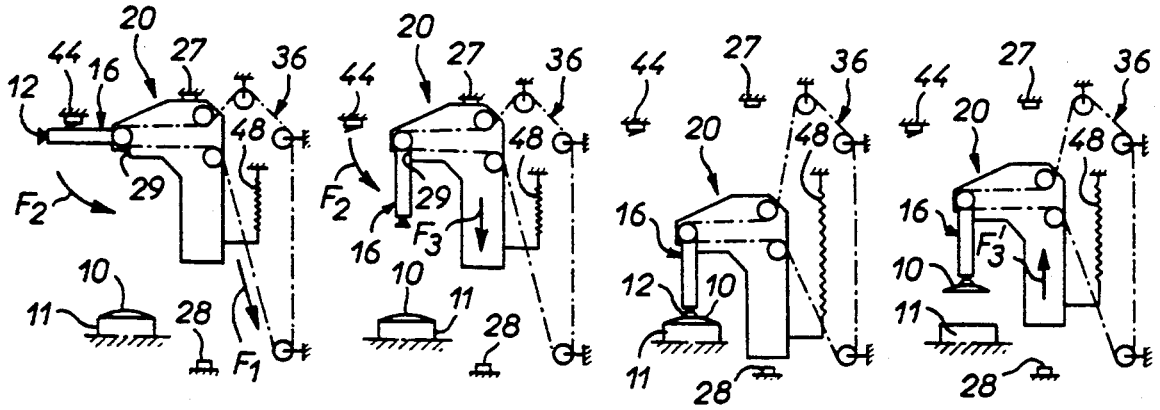
FIGS. 3A through 3D are schematic views in elevation of the device in various successive phases of its operation.

When the eyeglass lens 10 has been put onto the plate 11 and its position on the plate 11 checked, for example through the aperture 33 delimited by the arm 16 and the front part 26 of the carriage 20, the operator presses the pushbutton 46 which starts the electric motor 41 which drives the belt 36 in the direction of the arrow F1 in FIG. 3A.

Initially, due to the force applied to the carriage 20 by the spring 48, the carriage 20 continues to be held against the top abutment 27 and the only effect of the movement of the belt 36 in the direction of the arrow F1 is to pivot the arm 16, as shown by the arrow F2 in FIGS. 3A and 3B. The arm 16 then moves from its loading and offloading position to its fitting position in which it bears against the abutment 29 provided for this purpose on the carriage 20 (see FIG. 3B).

This moves the arm 16 away from the end of travel sensor 44.

However, the control unit 45 includes a relay which prevents the reversing of the power supply to the electric motor 41 which would otherwise occur, and which would reverse its direction of rotation.

The belt 36 continues to be driven in the direction of the arrow F1 and thereafter moves the carriage 20 in the direction of the arrow F3 (see FIG. 3B).

The carriage 20 therefore moves away from the top abutment 27 and towards the bottom abutment 28, tensioning the spring constituting its return spring means 48.

During this movement the holding part 12 carried by the arm 16 is applied to the eyeglass lens 10 on the plate 11 (see FIG. 3C).

Because of the resulting resistance and through the action of means which will not be described here as they do not constitute part of the present invention, the relay in the control unit 45 changes state to reverse the direction of rotation of the electric motor 41.

If there is no eyeglass lens 10 on the plate 11 the carriage 20 comes into contact with the bottom abutment 28 which likewise reverses the direction of rotation of the electric motor 41.

When the rotation direction is reversed the spring return means 48 of the carriage 20 return the carriage 20 towards the top abutment 27 in the direction of the arrow F'3 (see FIG. 3D).

The holding part 12 on the arm 16 entrains with it the eyeglass lens 10. Because of the action of the return spring means 48, the arm 16 advantageously remains in the fitting position, against the abutment 29 on the carriage 20.

The distance moved by the eyeglass lens 10 is therefore small, which facilitates its removal from the plate 11 without risk of interference with other parts that may be near the plate 11.

It is not until the carriage 20 is again in contact with the top abutment 27 that the belt 36 driven by the electric motor 41 returns the arm 16 to the loading and offloading position as seen in the initial configuration shown in FIG. 3A.

On returning to its loading and offloading position the arm 16 operates the end of travel sensor 44 which cuts off the supply of electrical power to the electric motor 41.

The operator then has only to remove from the arm 16 the eyeglass lens 10 to which the holding part 12 has been fastened.

Figure 4:
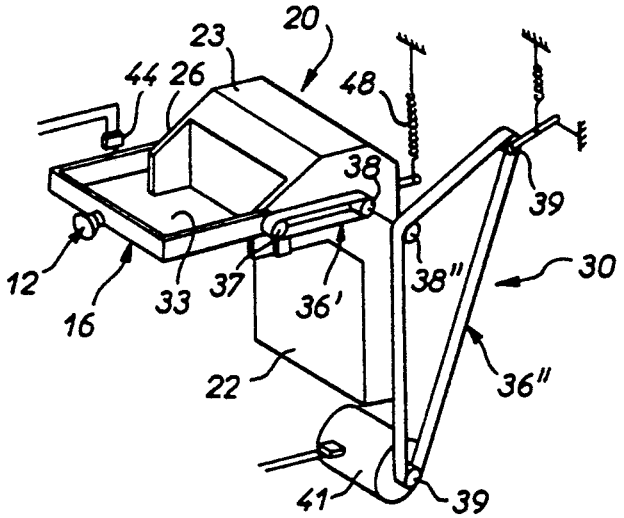
FIG. 4 is a schematic showing another embodiment, repeating parts of FIG. 2.

In the FIG. 4 embodiment the transmission 30 includes two belts, namely a first belt 36' running in an endless loop around the gear 37 with which the pivot axis 34 of the arm 16 rotates and a gear 38 carried by the carriage 20, and a second belt 36" which runs in an endless loop around a gear 38" which rotates with the gear 38, a gear 39 fixed in position relative to the frame 21 and which rotates with the output shaft 40 of the electric motor 41, and a direction-changer gear 39 also fixed in general position relative to the frame 21 but able to oscillate relative to the latter to tension the belt 36" appropriately, irrespective of the position of the carriage 20.

Otherwise the arrangements are of the same kind as previously described, as is the operation of the system.

In the description so far, the carriage 20 is in one piece.

Figure 5:
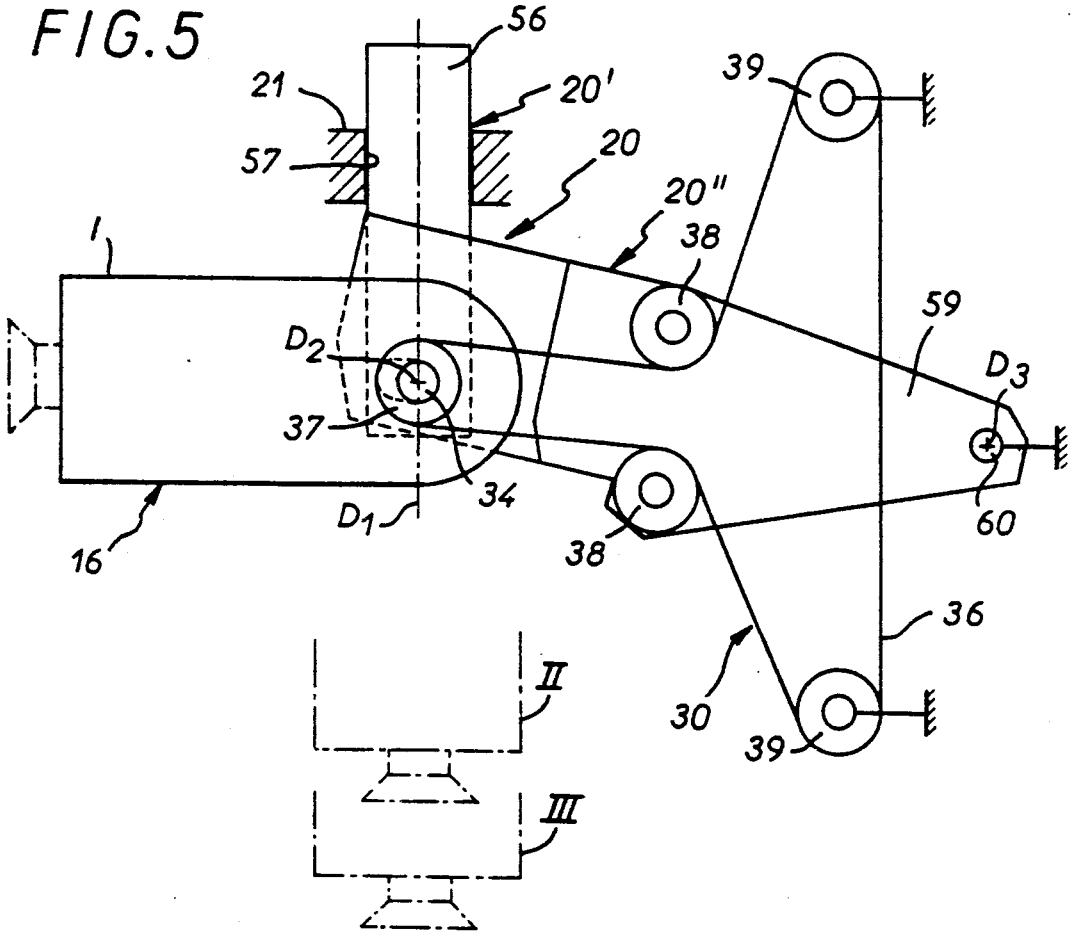
FIG. 5 is a schematic relating to a further embodiment, shown in elevation and in the loading and offloading position of the arm.
Figure 7:
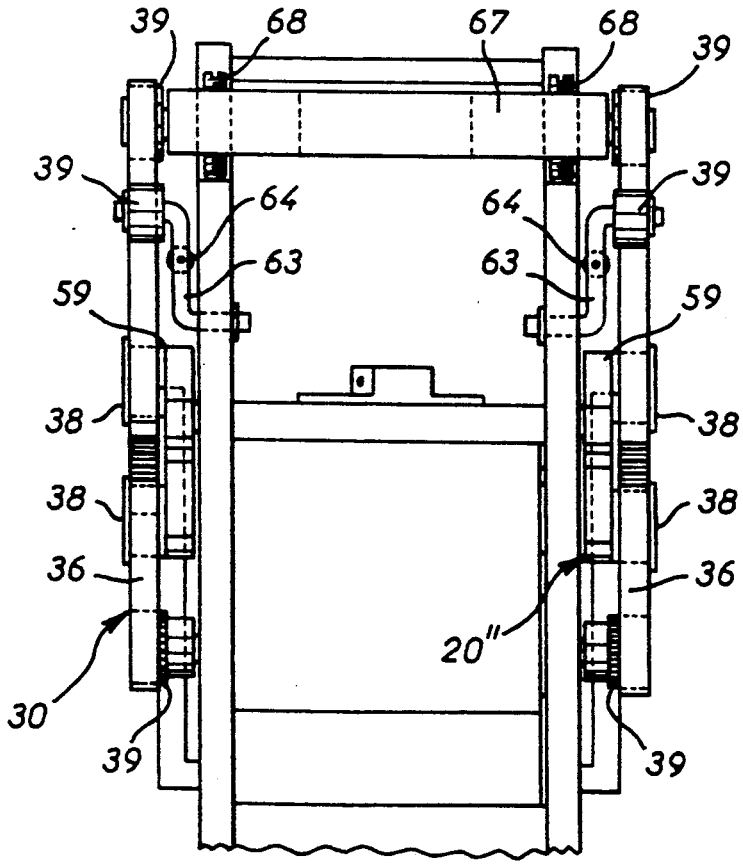
FIG. 7 is a partial rear view of it as seen in the direction of the arrow VII in FIG. 6.
Figure 6:
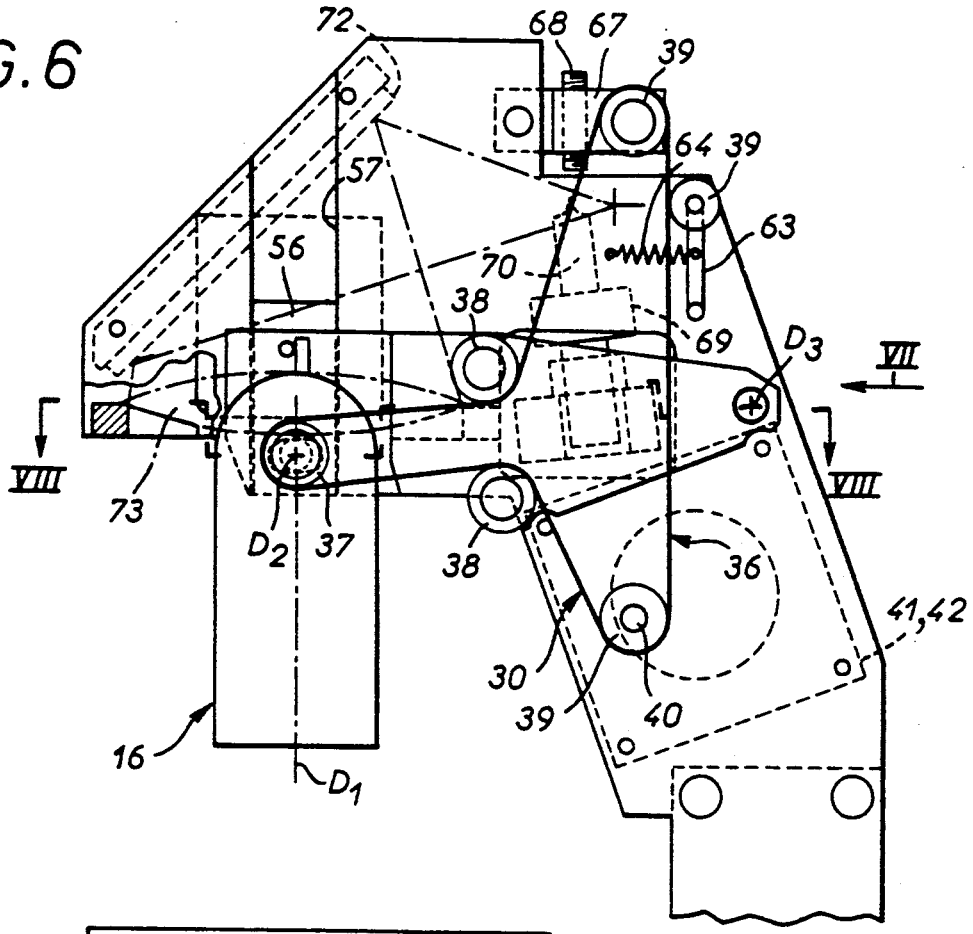
FIG. 6 is a view in elevation of this embodiment to a different scale and in the fitting position of the arm.
Figure 8:
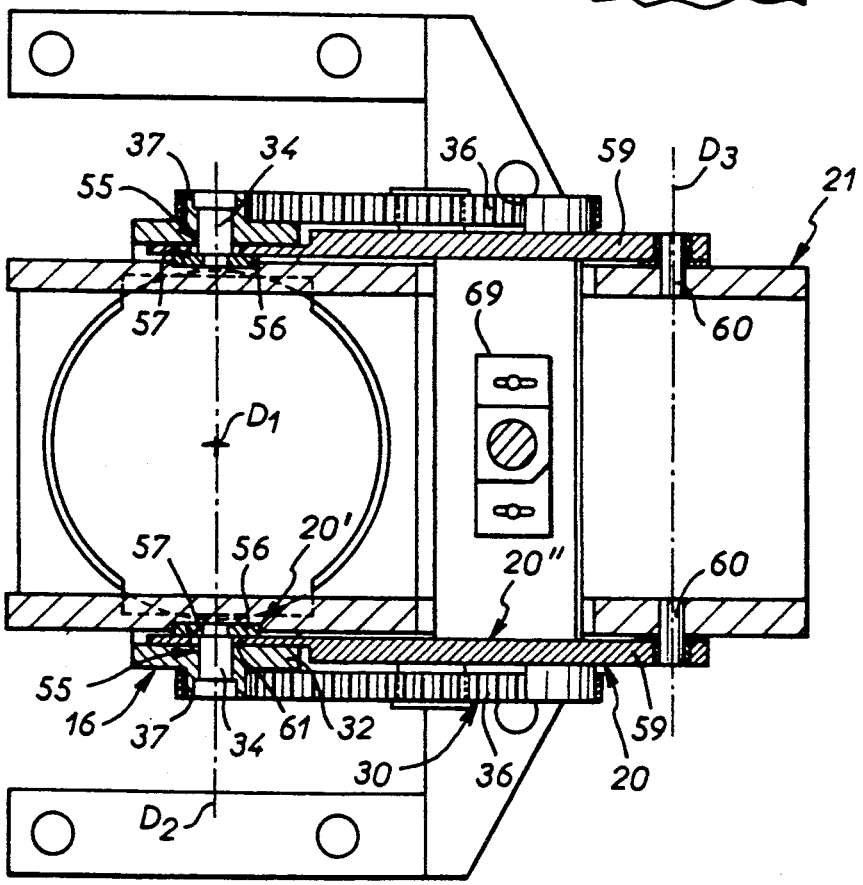
FIG. 8 is a partial view of it in transverse cross-section on the line VIII—VIII in FIG. 6.

In the embodiment shown in FIGS. 5 through 8 it is in two parts, namely a slide part 20' which is movable in a straight line on the frame 21 in the direction D1 perpendicular to the plate 11, which is not shown in FIGS. 6 and 8, and a handle part 20" meshing through a lost motion articulation 55 with the aforementioned slide part 20' and mounted to pivot on the frame 21 in a third direction D3 parallel to the direction D2 of the pivot axis 34 of the arm 16.

The direction D1 in which the slide part 20' moves in a straight line and the direction D2 of the pivot axis 34 of the arm 16 are in practice coplanar.

As a result, when the sucker 13 is applied to the eyeglass lens 10 the direction of the corresponding application force is advantageously coincident with the direction D1 in which the carriage 20 moves.

This improves the operating conditions in general and in particular the conditions of fitting the sucker 13.

In this embodiment the slide part 20' of the carriage 20 includes two parallel bars 56 on respective sides of the frame 21 and engaged with respective grooves 57 on the exterior flanks of the frame 21.

In practise this slide part 20' of the carriage 20 is reduced to these two bars 56, which are respectively engaged with the journals 34 defining the pivot axis of the arm 16.

As previously, the arm 16 is stirrup-shaped with a middle part 31 including the receptacle in which the sucker 13 is placed and two side arms 32.

In this embodiment the handle part 20" of the carriage 20 comprises two parallel links 59 articulated by journals 60 to the frame 21 in the direction D3. They extend laterally between the side arms 32 of the arm 16 and the bars 56 constituting the associated slide part 20'. The lost motion articulation 55 of each link 59 includes a radial slot 61 fitting without circumferential clearance over the corresponding journal 34.

In this embodiment the journals 34 are carried by the side arms 32 of the arm 16.

They could equally well be carried by the bars 56, however.

In this embodiment the associated transmission 30 comprises two parallel belts 36, one on each side of the carriage 20 and therefore of the frame 21.

As previously each of the belts 36 runs in an endless loop around a gear 37 with which the pivot axis 34 of the arm 16 rotates, two gears 38 rotatably mounted on the carriage 20 and two gears 39 carried by the frame 21.

However, in this embodiment the gears 37 are in one piece with the side arms 32 of the arm 16 and the gears 38 carried by the carriage 20 are rotatably mounted on the handle part 20" of the latter.

Furthermore, there is provided for each belt 36 in this embodiment, as previously, an additional gear 39 carried by the frame 21 and acting as a tensioner. The gear 39 is rotatably mounted on a lever 63 pivoted to the frame 21 and acted on by spring means in the form of a simple spring 64, for example, pressing it against the outside of the corresponding belt 36 to take up any slack in the belt 36 as the carriage 20 moves.

In this embodiment the gears 39 carried by the frame 21 towards the top abutment 27 of the carriage 20 (not shown in these figures) are rotatably mounted on a bracket 67 bearing on the frame 21 in a manner that is adjustable by means of screw 68; in this way the belt 36 can be tensioned appropriately beforehand.

The other gears 39 carried by the frame 21 towards the bottom abutment 28 of the carriage 20 rotate with the output shaft 40 of a motor/speed reducer 41/42, as previously.

In this embodiment the aperture delimited by the arm 16 and the carriage 20 is used to illuminate the plate 11 on which the eyeglass lens 10 is placed.

To this end the frame 21 includes a support 69 to which are attached a lamp 70, a mirror 72 and a condenser 73.

The remaining arrangements are of the same kind as previously described, in particular with reference to the return spring means which urge the carriage 20 towards its top rest position at all times and the abutment provided on the carriage 20 for the arm 16.

This embodiment therefore operates in the same way as the previous embodiment: when the motor/speed reducer 41/42 is started the arm 16 initially pivots from its loading and offloading position I shown in full line in FIG. 5 to an intermediate position II at right angles to the former position and shown in chain-dotted line in FIG. 5. The arm 16 then moves from this intermediate position II to its fitting position III shown in chain-dotted line in FIG. 5 and in full line in FIG. 6.

Of course, the present invention is not limited to the embodiments described and shown but encompasses any variant execution and/or combination of their various component parts.

The arm is described as pivoting before the carriage moves downwards away from its upper abutment purely for convenience above, to clarify the description.

In reality these movements can take place conjointly, the carriage beginning to move down at the same time as the arm begins to pivot, and vice versa.

What is more, in a manual embodiment the carriage is moved downwards by hand and it is the downward movement of the carriage which, through the belt and gear transmission in accordance with the invention, causes the arm to pivot.

There is claimed:

1. Device for fastening a holding part on an eyeglass lens placed on a plate, comprising an arm adapted to receive removably said holding part, a carriage on which said arm is able to pivot between a loading and offloading end position and a fitting end position and a frame on which said carriage is mobile between a rest end position and an end of travel end position over a path on which said arm that it carries is brought into alignment in said fitting end position with said plate, in which device said carriage is at least in part adapted to move in a straight line in a first direction controlled by a guide fastened to said frame and the pivot axis of said arm is in a second direction orthogonal to said first direction, and a belt and gear transmission is operative between said carriage and said arm to move said arm from one end position to the other.

2. Device according to claim 1 wherein said transmission comprises, constrained to rotate together by at least one belt, a rotary gear with which the pivot axis of said arm is constrained to rotate, at least one rotary gear carried by said carriage and at least one rotary gear fixed in position relative to said frame.

3. Device according to claim 2 wherein a single belt runs in an endless loop around said gear with which said pivot axis of said arm is constrained to rotate, two gears carried by said carriage on respective sides of said gear, and two gears fixed in position relative to said frame on respective sides of said carriage.

4. Device according to claim 3 comprising an additional gear on said frame.

5. Device according to claim 2 wherein at least one of said gears is constrained to rotate with the output shaft of a motor.

6. Device according to claim 5 wherein said gear constrained to rotate with said output shaft of said motor is one of said gears fixed in position relative to said frame.

7. Device according to claim 5 wherein, in its loading and offloading end position, said arm operates an end of travel sensor controlling the supply of electrical power to said motor.

8. Device according to claim 1 wherein said carriage has an abutment against which said arm bears in its fitting end position.

9. Device according to claim 5 wherein said carriage has an abutment against which said arm bears in its fitting end position and said carriage is acted on by return spring means adapted to urge it at all times towards its rest end position, said return spring means being adapted to exert on said carriage as it moves towards its rest end position sufficient force to hold said arm against said abutment provided for it on said carriage.

10. Device according to claim 1 wherein said frame carries abutments against which said carriage bears in its respective end positions.

11. Device according to claim 1 wherein, in its loading and offloading end position, said arm delimits in conjunction with said carriage an aperture.

12. Device according to claim 11 wherein said arm is stirrup-shape and is articulated to a front part of said carriage which is yoke-shaped.

13. Device according to claim 1 wherein said carriage is in one piece.

14. Device according to claim 1 wherein said carriage is in two parts, namely a slide part movable in a straight line in said first direction D1 and a handle part meshing through a lost motion articulation with said slide part and mounted to pivot on said frame in a third direction parallel to the direction of said pivot axis of said arm.

15. Device according to claim 1 wherein said carriage is in two parts, namely a slide part movable in a straight line in said first direction D1 and a handle part meshing through a lost motion articulation with said slide part and mounted to pivot on said frame in a third direction parallel to the direction of said pivot axis of said arm, and said gear carried by said carriage is carried by said handle part thereof.

16. Device according to claim 14 wherein the direction in which said slide part of said carriage is movable in a straight line and the direction of said pivot axis of said arm are coplanar.

17. Device according to claim 14 wherein said slide part of said carriage comprises two parallel bars engaged with grooves on said frame.

18. Device according to claim 17 wherein said slide part of said carriage comprises only said two bars.

19. Device according to claim 14 wherein said handle part of said carriage comprises two parallel links articulated to said frame.

20. Device according to claim 19 wherein said handle part of said carriage comprises said two links only and each of said two links includes a slot fitted over a journal with which the corresponding bar is engaged.

* * * * *